United States Patent [19]

Schantz

[11] 4,058,259

[45] Nov. 15, 1977

[54] HANDLE AND STAND FOR PRESSURE SPRAYING

[75] Inventor: Socrates J. Schantz, Marine, Ill.

[73] Assignees: John S. Schantz; Raymond G. Schantz, both of Marine, Ill. ; part interest to each

[21] Appl. No.: 698,946

[22] Filed: June 23, 1976

[51] Int. Cl.[2] ..... B05B 7/30

[52] U.S. Cl. ..... 239/276; 239/318; 248/86

[58] Field of Search ..... 239/276, 280, 312, 280.5, 239/318; 248/86, 83

[56] References Cited

U.S. PATENT DOCUMENTS

| | | | |
|---|---|---|---|
| 807,184 | 12/1905 | Malnburg | 239/276 X |
| 2,126,718 | 8/1938 | Batenburg | 239/280 |
| 2,514,225 | 7/1950 | Dabrohua | 239/312 X |
| 3,447,753 | 6/1969 | Proctor et al. | 239/317 |
| 3,908,910 | 9/1975 | Detwiler | 239/280 |

*Primary Examiner*—Evon C. Blunk

*Assistant Examiner*—MIchael Mar

*Attorney, Agent, or Firm*—Glenn K. Robbins

[57] ABSTRACT

A remote control handle for use with a pressure sprayer cannister for mixing a concentrated spray solution with an external liquid under pressure. The handle comprises an elongated rigid tube of about an arm's length which is connected at one end to a garden hose and at the other end to the cannister. A normally closed valve on the handle adjacent the garden hose connection is used for regulation of the flow of liquid to the cannister. A rinse hose which is normally closed is provided for rinsing the hands of the user. A specially constructed pivotable stand is connected adjacent the cannister connection end and is adapted to support the unit on the ground for unattended spraying use. A stop is provided to limit the stand's position. The stand is specially constructed of two rod-like members and a spring so that it can be fastened in collapsed position to the tubular member. The stand is further provided with a hook-like extension over which a handle on the rinsing hose can be connected to store the rinsing hose.

5 Claims, 5 Drawing Figures

HANDLE AND STAND FOR PRESSURE SPRAYING

SUMMARY OF THE INVENTION

Various types of pressure sprayer cannisters have been employed by gardners those working in orchards, car washing and the like. These cannisters are adapted to be filled with insecticides, toxic solution for spraying garden plants, orchard trees, detergents and a variety of other chemical solutions. The cannister is adapted to receive a garden hose or the like for distribution of water under pressure through the cannister. By means of a controlled ratio mixing of the concentrated insecticide or other chemical solution with water is effected by suction. The mixed solution is then directed from the cannister in a spray to the area to be sprayed. It has been an objection in the past that the user must hold the cannister and that in the process of use some of the sprayed solution is sprayed or otherwise obtained on the hands or clothing of the user. Further a supply of water is always directed through the cannister until turned off at a remote hydrant or the like.

By means of this invention there has been provided a remote control handle with valve control means for connection to a coventional sprayer cannister. This handle is comprised of a long rigid tubular member, such as a steel pipe, in the order of the length of the arm of the user or thereabouts and one-half to three-fourths inch internal diameter which can be connected between the hose and the cannister. The proximity of the hands of the user to the cannister is thereby avoided to prevent accidental contamination with the sprayed solution. The remote control handle has a normally closed valve and the entire handle can be simply directed with the cannister at the end to any area desired to be sprayed. The tubular member can be used with an extension by a simple connection to an extension to increase its effective length. This is of use in spraying orchard trees at height that are normally not reachable.

In order to provide for washing the hands of the user or other areas, rinsing hose is connected to the remote control handle. This rinsing hose is much in the fashion of a dish water rinsing hose and made of flexible hose and a normally closed spray head connected to the tubular member up-stream of the control valve so that water pressure is always available to both the rinsing and sprayer. The rinsing sprayer is adapted to be connected to the rigid tubular member at a forward portion so that it can be stored or held out of the way when not in use.

A further feature of this invention is the provision of a pivotable stand adjacent the cannister connecting end. This pivotable stand is adapted to be positioned at right angles or perpendicular to the rigid tubular member in order that the stand can be supported on or in the ground in a triangular fashion with the valve control end resting upon the ground. In this fashion the cannister and the remote control handle are directed upwardly in a triangular manner so that the entire unit can be left on the ground unattended and used to spray the desired area over a period of time. The stand is of particular and special construction in order that it can be used in the stand erected position whereby a stop member holds the stand from pivoting any more than 90° to the tubular handle. In the collapsed position the construction of the stand from a pair of spaced apart rod like members extending parallel to one another and connected at the bottom portion by a spring makes possible a clamping of the stand to the handle. The rod like members are spaced together a distance slightly less than the outer diameter of the tubular handle in order that the rod like members can be spread apart against the spring pressure slightly over the center of the tubular handle. When so spread apart a stop on the spring member which is of a coil-like construction retains or clamps the stand in the collapsed position against the tubular handle.

One of the rod members of the stand has an extension formed in the nature of a hook whereby a handle of the rinse hose valve can be secured to it to hold the rinse hose handle. This feature provides for the storing or holding of the rinse hose to the handle out of the way when not in use.

The above features are objects of this invention and further objects will appear in the detailed description which follows and will otherwise be apparent to those skilled in the art.

For the purpose of illustration of this invention there is shown in the accompanying drawings a preferred embodiment thereof. It is to be understood that these drawings are for the purpose of example only and that the invention is not limited thereto.

IN THE DRAWINGS

DESCRIPTION OF THE INVENTION

Figure 1:
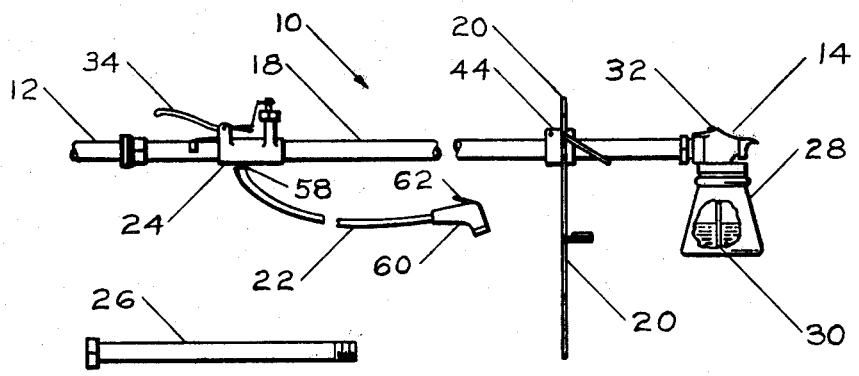
FIG. 1, is a side elevation partially broken apart showing the spray hose removed from the handle with the stand positioned and ready for ground engagement.
Figure 2:
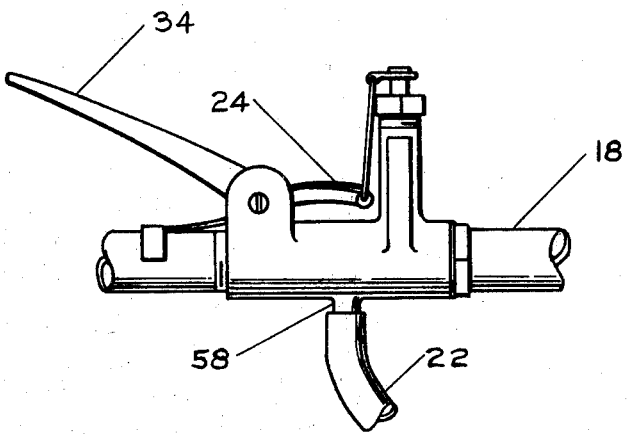
FIG. 2, is an enlarged view in side elevation of the valve control means of the tubular handle.

The remote control handle of this invention is generally designated by the reference numeral 10 in FIG. 1. It is connected at one end to a garden hose 12 and at the forward end to a conventional pressure spray cannister 14. The remote control handle 10 is comprised of a rigid tubular member 18, a stand 20 which is shown in the ground engaging position in FIG. 1, a rinse hose 22 shown ready for use and a main control valve 24. An additional tubular extension 26 is also shown for use for increased length where desired. The cannister 14 is of conventional type such as that shown in Hayes U.S. Pat. No. 2,571,871. This cannister has a jar portion 28 which may be filled with insecticide or detergent, solution or the like or any type of solution which is desired to be mixed with water from the garden hose for dilution and spray use. A dip tube 30 extends into the jar 28 and by suction caused by the pressure of water from the garden hose the metering and proportioning of the solution with the water from the garden hose is effected. The spray cannister works on a suction or vacuum principle effected by the garden hose water pressure to pick up or suck up the dip tube 30 the concentrated solution. A bleed hole 32 is provided in such cannisters which is preferably closed partially or completely in the instant invention by a conventional adjustment screw. When the bleed hole 32 is opened suction is reduced and pure water will be sprayed and when closed the highest concentration of mixing is effected. The main control valve 24 provides remote control means for stopping the flow of water to the cannister whereby the bleed hole need not be employed and may be left completely closed.

The valve 24 on the tubular handle has a handle portion 34. The valve is normally closed and by engagement of the handle 34 in the downward direction water is caused to flow through the tubular member and pass the cannister where it is mixed with the jar solution and sprayed.

Figure 3:
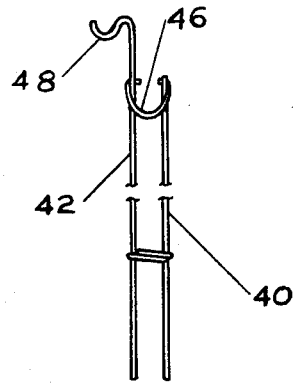
FIG. 3, is a broken apart view in elevation of the stand.
Figure 4:
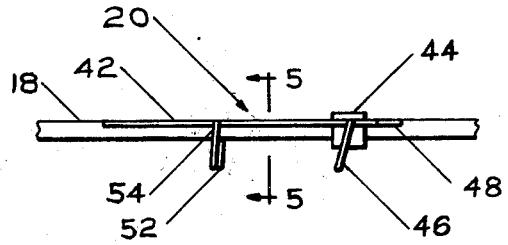
FIG. 4, is a fragmentary view in side elevation showing the stand in collapsed position.
Figure 5:
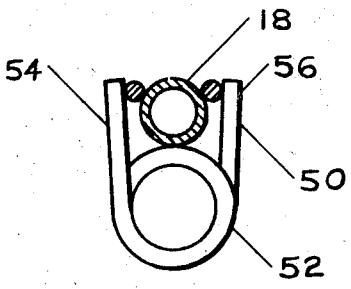
FIG. 5, is an enlarged view in section taken on the line 5—5 of FIG. 4.

The pivotable stand 20 is best shown in FIGS. 3, 4 and 5. It is comprised of a pair of rod-like members 40 and 42 pivoted to clamp 44 which is rigidly clamped to the tubular member 18 as best shown in FIG. 1.

A stop member 46 rigidly connected to the rod-like members as shown in FIG. 3 and also FIG. 1, serves as a stop member to limit movement of the stand to the ground engaging position shown in FIG. 1. The rod-like member 42 of the stand further is provided with an extension as shown in FIG. 3, having a hook portion 48. This hook portion serves to provide a rest for the rinse hose when not in use. The lower portion of the stand as best shown in FIG. 3 and 5 has means for clamping the stand to the tubular member 18 when the stand is not in use. Thus the lower portions of rod-like members 40 and 42 are spaced apart a distance slightly less than the outer diameter of the tubular member 18 of the handle 10. A U-shaped spring 50 having a coil portion 52 and two arms 54 and 56 connected to the rod-like members enables them to be spread apart slightly and snapped over the outer surface of the tubular member of the handle. In this fashion the stand can be adjusted to the collpased or rest positon where it fits snugly against the tubular handle as shown in FIG. 4. The coil 52 of the spring also serves as a stop to hold or retain the stand in this collapsed position.

The rinse hose 22 is connected to the tubular handle 58 on the valve 24 just upstream of the valve control means. Thus water pressure is always available through the hose 22 to the rinse valve 60. The rinse valve 60 is normally closed and is of conventional construction such as used in the conventional spray rinse hose in kitchen sinks. When not in use a handle 62 of the rinse valve is hooked over the hook portion 48 of the stand so that it can be positioned out of the way of the user.

Use:

The remote control tubular handle 10 of this invention is very simply employed. The upstream end of the handle is first of all connected to garden hose 12 in conventional fashion. The forward end is then connected to the hose fitting conventionally supplied on the spray cannister 14. If the spray cannister has a bleed hole 32 this is closed so that water pressure is always supplied to the cannister. Mixing is effected through the dip tube 30 in the solution that is used in the cannister. The mixed spray from the cannister can be used for spraying various insecticides or herbicidal solutions as well as detergent solutions for car washing or the like as desired by the user.

In use the user simply employs the handle 34 of the valve to cause water pressure to be supplied to the cannister 14 and the mixed spray solution is then directed in the desired fashion to the object to be sprayed. To stop the spraying the user simply releases the handle 34 and the normally closed valve 24 closes and no further water is supplied to the cannister.

When the spraying is desired to be continued over a long period of time the stand 20 is removed from the collapsed position through the release of the biasing spring 50 and moved to the perpendicular position shown in FIG. 1. The stand may be then rested on the ground in triangular support or the rod-like members can be simply thrust into the ground. The spraying will take place in the manner aforedescribed. Where the user desires to maintain the spraying and remove himself from the area the handle 34 can be clamped down by a rubberband or conventional clamp or the like as desired to keep open the valve 24.

When the spraying is completed the user can wash himself or any area desired by use of the rinse hose 22. The handle 62 is simply depressed and the valve 60 is thereby opened causing rinse water to flow for the use as desired by the user. When not in use the rinse hose is simply hooked to the hook portion 48 of the stand.

Various changes may be made in this invention as will readilly apparent to those skilled in the art. Such changes and modifications are within the scope and teaching of this invention as defined by the claims appended hereto.

What is claimed is:

1. A remote control handle for a pressure sprayer cannister having means for mixing a concentrated spray solution with an external liquid under pressure, said handle comprising an elongated rigid tubular member of at least about an arm's length, means for connecting a first end of said tubular handle to the cannister and a second end to a flexible hose for providing liquid under pressure, a normally closed valve adjacent the second end for regulating the flow of liquid to the cannister and a pivotable stand, said stand being pivotably connected to the handle adjacent the cannister and having a rod-like free end member adapted to be driven into the ground directly underneath the handle to support the handle upon the ground in a triangular position said end member comprising a pair of substantially parallel rigid rod elements connected to one another and spaced apart for receiving and supporting said handle, and which are adapted to be stuck in the ground, said stand being pivotally connected to the handle by an element having a pair of inwardly turned ends for pivotally supporting said tubular handle member.

2. The remote control handle of claim 1, in which a rinse hose is connected to the handle upstream of said normally closed valve and said rinse hose is provided with valve control means.

3. The remote control handle of claim 1, said rod elements are spaced slightly less than the diameter of the tubular member and are connnected by a U-shaped spring element, said rod elements being spreadable to fit over the tubular member and said spring element having a retaining portion to retain the rod elements in a stand collapsed position on the tubular member.

4. The remote control handle of claim 1, in which the stand is comprised of a rigid elongated support member having one end pivotably connected to the tubular member and the other end adapted to be supported on the ground, said support member being comprised of a pair of rigid rod elements spaced apart at a lower portion which are adapted to be stuck in the ground, said rod elements being spaced slightly less than the diameter of the tubular member and being connected by a U-shaped spring element, said rod elements being spreadable to fit over the tubular member and said spring element having a retaining portion to retain the rod elements in a stand collapsed position on the tubular member and the stand has a hook-member extending beyond the pivotal connection which receives a handle of the rinse valve control means in both the stand collapsed and ground engaging positions.

5. The remote control handle of claim 1, in which said support member is further provided with a stop member engageable with the tubular member to limit the movement of the support member from substantially 90° movement from a substantially co-axial position parallel to the tubular member to a position at about 90° to the tubular member.

* * * * *